US006755051B2

(12) United States Patent
Israel

(10) Patent No.: US 6,755,051 B2
(45) Date of Patent: Jun. 29, 2004

(54) KNITTED GARMENTS AND METHODS OF FABRICATION THEREOF

(75) Inventor: Rachel Israel, Nahariyah (IL)

(73) Assignee: Delta Galil Industries, Ltd., Tel-Aviv (IL)

( * ) Notice: Subject to any disclaimer, the term of this patent is extended or adjusted under 35 U.S.C. 154(b) by 44 days.

(21) Appl. No.: 10/265,439

(22) Filed: Oct. 7, 2002

(65) Prior Publication Data

US 2004/0065124 A1 Apr. 8, 2004

(51) Int. Cl.[7] ..... D04B 9/42
(52) U.S. Cl. ..... 66/177 R; 66/8
(58) Field of Search ..... 66/169 R, 170, 66/171, 172 R, 173, 172 E, 175, 176, 177, 178 R, 196, 8, 17; 2/400, 401

(56) References Cited

U.S. PATENT DOCUMENTS

| | | | | | |
|---|---|---|---|---|---|
| 2,043,715 | A | | 6/1936 | Schuessler | 66/172 |
| 3,613,119 | A | | 10/1971 | Sarmiento | 2/224 |
| 3,629,871 | A | | 12/1971 | Sarmiento | 2/224 |
| 3,703,820 | A | | 11/1972 | Jackson | 66/177 |
| 3,740,974 | A | | 6/1973 | Bourgeois | 66/193 |
| 3,812,692 | A | | 5/1974 | Arndt | 66/172 |
| 3,875,768 | A | | 4/1975 | Arndt | 66/172 |
| 4,047,399 | A | | 9/1977 | Frost et al. | 66/149 |
| 4,048,819 | A | | 9/1977 | Johnson | 66/177 |
| 4,259,749 | A | | 4/1981 | Krug et al. | 2/244 |
| 4,624,115 | A | | 11/1986 | Safrit et al. | 66/172 |
| 4,663,946 | A | | 5/1987 | Wright | 66/177 |
| 4,682,479 | A | * | 7/1987 | Pernick | 66/176 |
| 4,736,468 | A | | 4/1988 | Efird et al. | 2/400 |
| 4,793,034 | A | | 12/1988 | Poloff et al. | 28/153 |
| 4,887,439 | A | | 12/1989 | Tenconi | 66/51 |
| 5,052,058 | A | * | 10/1991 | Mueller | 2/228 |
| 5,081,854 | A | | 1/1992 | Lonati | 66/176 |
| 5,479,791 | A | * | 1/1996 | Osborne | 66/171 |
| 5,553,468 | A | | 9/1996 | Osborne | 66/171 |
| 5,596,939 | A | | 1/1997 | La Velle et al. | 112/130 |
| 5,605,060 | A | * | 2/1997 | Osborne | 66/171 |
| 5,671,615 | A | | 9/1997 | Kjaergaard et al. | 66/177 |
| 5,746,068 | A | * | 5/1998 | Popa et al. | 66/176 |
| 5,823,012 | A | | 10/1998 | Hacskaylo | 66/171 |
| 5,836,179 | A | | 11/1998 | van Laar | 66/171 |
| 5,890,380 | A | | 4/1999 | Ives et al. | 66/170 |
| 6,079,236 | A | | 6/2000 | Ives et al. | 66/170 |
| 6,164,094 | A | | 12/2000 | Lonati et al. | 66/172 |
| 6,192,717 | B1 | | 2/2001 | Rabinowicz | 66/177 |

FOREIGN PATENT DOCUMENTS

| | | | |
|---|---|---|---|
| BG | 0099625 | A | 1/1996 |
| EP | 0 711 366 | B1 | 10/1997 |
| EP | 0 926 285 | A2 | 6/1999 |
| EP | 0 820 542 | B1 | 8/1999 |
| EP | 0 967 314 | A2 | 12/1999 |
| EP | 0 979 042 | B1 | 3/2002 |
| GB | 2 076 634 | A | 12/1981 |
| GB | 2 152 359 | A | 8/1985 |
| WO | WO 94/11554 | | 5/1994 |

OTHER PUBLICATIONS

"Guide to WHOLEGARMENT", Shima Seiki Mfg., Ltd., Press Release, 7th OTEMAS, http://www.shimaseiki.co.jp/, 3 pages.

* cited by examiner

*Primary Examiner*—Danny Worrell
(74) *Attorney, Agent, or Firm*—Mintz Levin Cohn Ferris Glovsky & Popeo, P.C.

(57) ABSTRACT

A method for fabricating a garment comprising the steps of knitting a tubular preformer having at least one band of edging material circumferentially and integrally knitted therewith, and continuing knitting the knitted tubular preformer to fabricate a knitted fabric section from which a garment body section having apertures may be cut, then cutting the band of edging material and the garment body section having at least one aperture from the preformer, and attaching the band of edging material to the garment body section around the perimeter of the aperture.

39 Claims, 5 Drawing Sheets

KNITTED GARMENTS AND METHODS OF FABRICATION THEREOF

FIELD OF THE INVENTION

The present invention relates to knitted garments having knitted edging sewn thereto, and particularly, but not exclusively, to knitted underwear having elasticized knitted edging affixed around the apertures thereof. It also relates to novel methods for constructing garments from knitted fabrics.

BACKGROUND OF THE INVENTION

The Santoni® knitting machine and similar machines for producing jacquard type, fully finished knitting, have enabled the production of tubular garments, and provide a means of producing seam-free knitted garments that are comfortable to the wearer and economical to manufacture.

As described in U.S. Pat. No. 6,164,094 to Francesco Lonati et al., the garments produced may have integrally knitted upper apertures, (that is neck holes for undershirts and the like, and waists for underpants), and differently knitted portions for cutting away to produce apertures for leg-holes or armholes, which may then be hemmed, or to which sleeves may then be attached.

Additionally, it is known to knit edging bands or ribbons which may be sewn to the apertures of garments as waist bands or for edging leg holes.

Apart from garments having essentially rectangular profiles, such as boxer-short type undergarments having their leg apertures parallel to their waist bands, it is impossible to knit waistbands, garment and leg-bands of an undergarment in one go, to produce seamless garments having all finished apertures integrally knitted therein.

Generally, the edging for leg apertures and/or arm apertures of undergarments are produced separately and sewn in place. Usually the material used for edging is less comfortable than that produced by the continuous knitting machines used for fabricating the garment itself. Often a seam is introduced across the leg-band of underpants or shoulder strap of under-vests, and this may be irritating to the wearer, and in hot and humid climates, or where the wearer exercises, may be a cause of skin rashes and dermatitis.

Some of the comfort issues have been resolved by producing knitted edging that may be attached to the apertures of the unfinished garment, by sewing for example.

U.S. Pat. No. 4,259,749 to Krug and Gluckin for example, describes a fold-over lace band for intimate apparel garments. This patent describes a knitted elastic fold-over edge band for edging garments such as women's panties, brassieres and the like. The band described is fabricated by knitting the first half using a jersey stitch for example, and then continuing to produce the other half using conventional Raschel or Tricot lace construction. The knitted jersey side is attached to the inside edge of the garment and contacts the wearer's skin, providing comfort, and the lace part is designed to be a decorative element. Typically, an edge of this kind will be left white. If dyed, it will be dyed to a different and contrasting colour to the fabric used for the body of the garment. Since the edging and the body of the garment are manufactured independently, the dye uptake will typically be slightly different. Even if co-dyed, it is very difficult to get absolute colour-matching of the outer part of the edging with the fabric used for construction of the body of the garment.

EP0820542 to Speich describes an apparatus for producing knitted ribbons having crochet-covered rubber threads. Having a very different structure to the fabric used for forming the garment body of the garments to which these are attached, the above detailed dying quality control problems are also problematic with the ribbons produced by this apparatus. Furthermore, it will be noted that the ribbons thus formed are fabricated on a different and distinct machine from the apparatus used for fabricating the body parts of the garment to which they are attached, requiring two separate knitting machines, and the necessary trained personnel to operate them.

U.S. Pat. No. 3,740,974 to Bourgeois for example, describes an elastic ribbon having fancy designs thereon, that is especially intended for sewing on the edges of underwear. This ribbon is produced on a straight drop stitch loom. Here again, and indeed wherever the edging of a garment is knitted separately and then attached to the body of the undergarment, it is very difficult, and on a commercial scale has proven next to impossible, to achieve good colour matching between garment and edging, when the garment is dyed. Even if the garment is fabricated and then dyed, typically the different portions having different weave, and often different fibers used in their construction, generally absorb colours to different extents and imperfect colour matching again results. If edging fabric and garment fabric are manufactured and dyed separately before being attached together, then on an industrial scale, there are often slight colour variations that adversely affect the aesthetic appearance of the garment.

U.S. Pat. No. 5,596,939 to LaVelle et al. describes an apparatus for forming tubular collars which cuts a knitted tubular fabric into bands that, after cutting to the right length and width, are then folded longitudinally and have their ends seamed together. Use of such an apparatus to form tubular collars for cuffs and the like, together with use of a different tubular knitter for the fabrication of garment body parts, provides garments having different threads and different dye uptake characteristics in different parts thereof. Whether sewn and then dyed, or, more conveniently, dyed and then sewn, maintaining uniformity of colour in all parts of garments thus formed is a serious quality control logistical problem.

Thus despite the crowded art of underwear design and manufacturing techniques, including the many patents that relate to knitted underwear, there is still a need to provide a method of producing knitted edging that is attachable to the apertures of knitted garments, such that the edging has identical dye absorption properties to the fabric used for the manufacture of the body of the garment, such that uniform colouring in all parts of the garment is practically realizable during mass production of knitted garments. The present invention is addressed to methods of providing knitted garments having uniform properties, particularly dye absorption properties, and is also addressed to providing garments having such uniform properties.

SUMMARY OF THE INVENTION

It is an aim of the present invention to provide knitted edging for attachment to an unfinished machine knitted garment, wherein the knitted edging has similar dye absorption properties to the unfinished machine knitted garment and may be dyed together with the unfinished knitted garment, and then sewn thereto, or alternatively, may be sewn to the unfinished knitted garment, and then dyed therewith to produce a consistent hue.

It is a further aim of the present invention to provide a simple and convenient means of transferring the dyed sections of knitted fabrics used for the body parts of a garment together with the dyed sections used for the edging, to be attached thereto, so that the seamstress may easily cut and sew corresponding body parts and edging, attaining high quality colour integrity in the modern, large scale mass production environment without complicated colour quality control procedures.

It is yet a further aim of the present invention, to provide knitted garments such as singlets or triangularly shaped underpants, having knitted edging around the perimeters of the apertures thereof, such that the colour of the edging and of the garment is identical.

It is still yet a further aim of the invention to provide a commercial method for fabricating two piece sets, where both pieces are dyed to an identical colour shade.

In a first aspect, the present invention is directed to a method for fabricating a garment comprising the steps of (i) knitting a tubular preformer having at least one band of edging material circumferentially and integrally knitted therein, (ii) knitting a fabric section from which garment body sections may be cut, for forming garment bodies having at least one aperture, (iii) cutting the band of edging material and the garment body section from the preformer, and (iv) attaching the band of edging material to the garment body section around the perimeter of the aperture.

Typically, the knitting of the tubular preformer is performed on a circular type knitting machine such as those manufactured by Santoni, Orizio and Sangiacombo.

Optionally, the band of edging fabric is fabricated from fibers that include elastic fibers, and the band of edging material is elasticized.

In some embodiments, the band of edging material is attached to an aperture of the garment body section as a continuous loop. However, the band of edging material may be opened out into a length of edging fabric, and then attached to the perimeter of the aperture of the body section as a loop having a closing seam.

Preferably, the step of attaching the band to the body section is by sewing.

The garment body section may have a seamless one piece knitted construction, or may have cut and sewn, multi-paneled construction.

Preferably the method for fabricating a garment further comprises the step of dying the at least one band of edging material and the garment body section, wherein the dying step may be performed either prior to, or subsequent to the sewing step.

The method for fabricating a garment optionally further comprises forming at least one further knitted edge, said further knitted edge being attached to the garment body section by being knitted integrally thereto, and not by being stitched or glued thereto.

The method for fabricating a garment is particularly applicable to the manufacture of underwear.

In a second aspect, the present invention is directed to providing a garment fabricated from a body section of knitted fabric, having at least one knitted edge attached around the perimeter of an aperture thereof by sewing, as manufactured in accordance with any of the above methods.

Optionally, the body section and the knitted edge are co-dyed to a uniform colour.

In a third aspect; the present invention is directed to providing a circularly knitted preformer for a garment comprising a plurality of bands of edging material circumferentially and integrally knitted therewith, separated by layers of cuttable waste material, and further comprising an area of knitted fabric from which at least one garment body section may be cut, wherein said bands of edging material are detachable from the preformer by cutting said cuttable waste material, and are attachable around an aperture of an unfinished garment formed from said body section, by stitches.

In one embodiment at least one garment body section may comprise front panels circularly knitted to back panels, for providing a garment without side seams.

In other embodiments, the circularly knitted preformer for a garment comprises a section of fabric from which a plurality of garment body sections may be cut out and sewn together to provide a multi-paneled garment.

Optionally the area of knitted fabric further comprises cut guide markings integrally knitted therein.

In a fourth aspect, there is provided a circularly knitted preformer for a plurality of garments comprising a plurality of bands of edging material circumferentially and integrally knitted therewith and separated by layers of a cuttable waste material, and further comprising a knitted fabric section of suitable knit and size for the fabrication thereof of body sections for at least two garments, wherein the bands of edging material are detachable from the preformer by cutting through the cuttable waste material, and are attachable around a perimeter of an aperture of a garment formed from the knitted fabric section, by sewing.

Optionally, the at least two garments includes at least two substantially identical garments. Alternatively, the at least two garments includes a bottom garment and a top garment, such that the bottom garment and the top garment comprise a two piece matching set.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
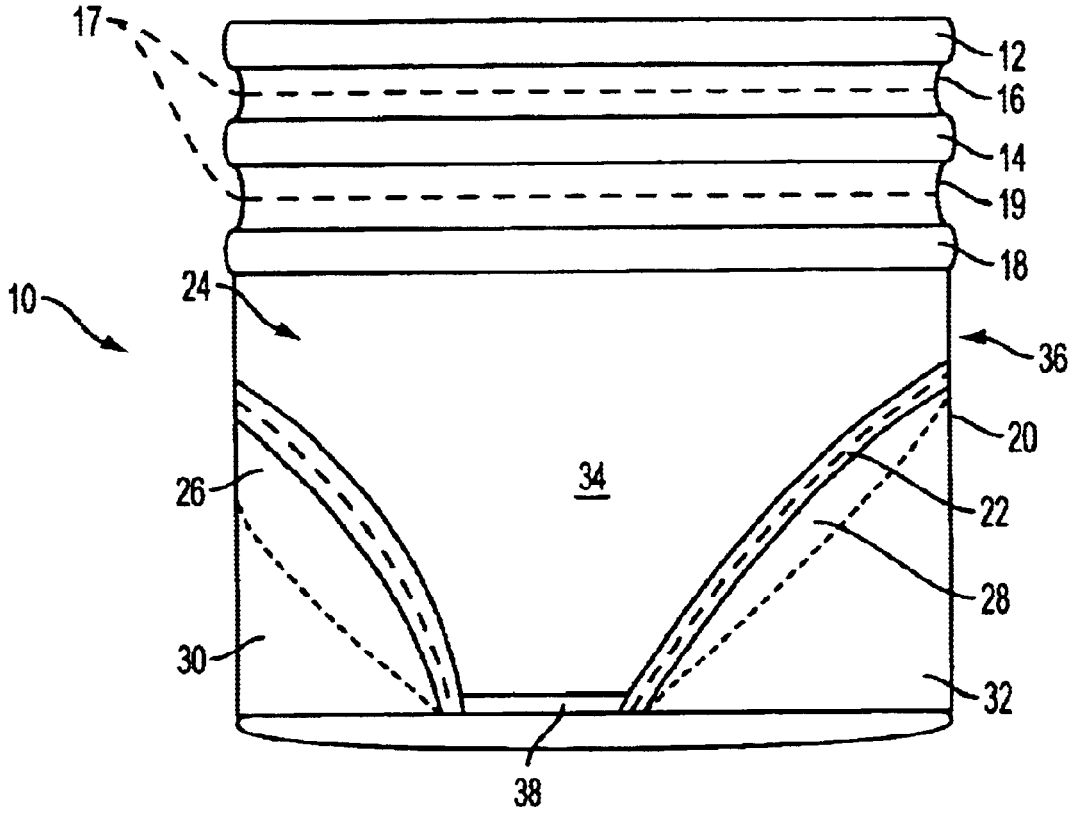
FIG. 1 shows a preformer for a garment of knitted fabric consisting of body parts of the garment and detachable knitted edges knitted therewith for subsequent attachment to the body parts, by sewing for example.

Referring now to FIG. 1, there is shown a preformer 10 for a garment of knitted fabric having knitted edges co-knitted therewith for subsequent attachment around apertures of a garment by sewing. The specific garment illustrated, is by way of example only, a pair of panties having a high leg cut. The preformer 10 is a continuously knitted tube of fabric having at least one band 12 of edging material circumferentially and continuously knitted therewith. As illustrated herein, there are two such bands 12, 14 divided from each other by a simple strip of knitted fabric 16. After the second band 14, there is knitted a second simple strip of knitted fabric 18, after which, there is knitted a garment body section 20 optionally and preferably having cut guide markings 22 integrally knitted therein to assist the seamstress, showing her where to cut the material to form the garment 24. Cutting along the cut guide markings 22 provides the edges that eventually form the leg apertures 26, 28 of the garment. Waste material 30, 32 is discarded, and the front 34 and back 36 sections of the garment are thus constructed as a single seamless piece that, once joined together at their bottom parts 38 to form the crotch, provides a garment body section 24 that has only one seam (in the crotch). Such a garment is most comfortable to the wearer, and is generally less visible through tight jeans or similar outer garments, than panties formed by "cut and sew" methods.

The bands 12, 14 typically include elastic fibers arranged to give increased circumferential resilience, allowing a high degree of circumferential stretch. The strips of fabric 16 and 19 may include integrally knitted markings 17, typically having lower densities of threads, for easy cutting. In this manner, by cutting through the strips of fabric 16 and 19, bands 12, 14 may be detached and then sewn around the perimeter of apertures 26, 28 of the garment body part 24 to form seamless knitted edging, overlooking being a particularly appropriate industrial sewing stitch for this purpose, allowing the two pieces to be joined such that their edges are prevented from unraveling.

The front and back panels 34, 36 of the garment body part 24 may have, integrally knitted therewith, a waist band 18 that is knitted thereto, in situ, and is not designed to be removed and sewn in place. Such integral waist bands are known in the prior art.

Figure 2:
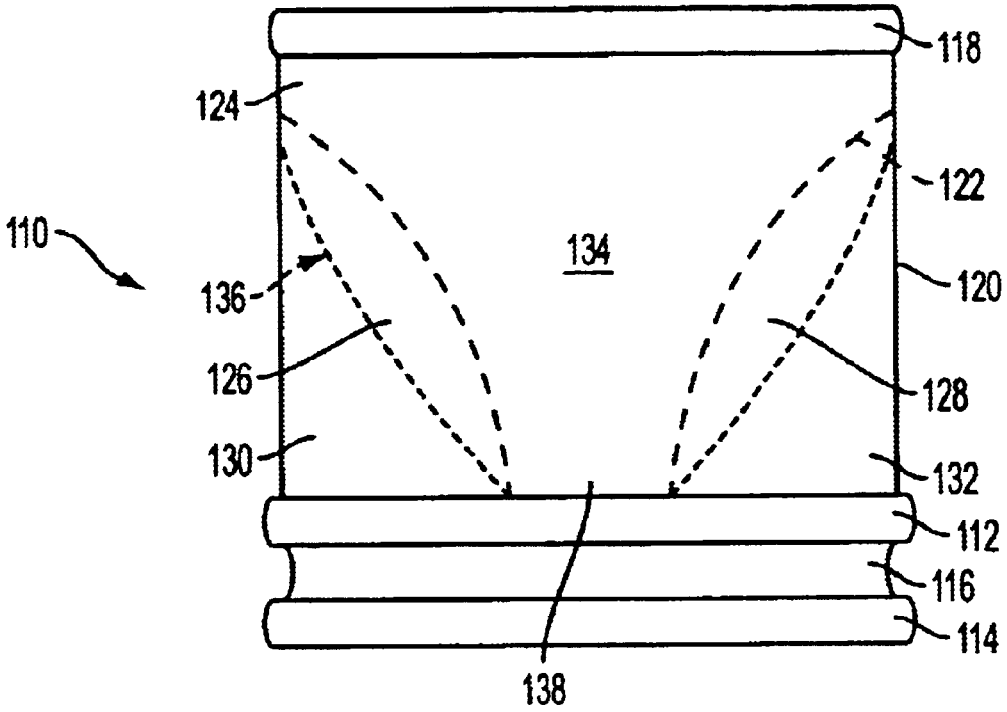
FIG. 2 shows a second preformer for a garment of knitted fabric having detachable knitted edges knitted therewith for subsequent attachment to the garment.

FIG. 2 shows an alternative preformer 110 for fabricating therefrom a similar garment of knitted fabric having knitted edges co-knitted therewith for attachment thereto by sewing, to that fabricable from the preformer 10 shown in FIG. 1. Here again, for purpose of illustration only, the garment is once again a pair of panties having a high leg cut. The preformer 110 is a continuously knitted tube of fabric starting with an annulus of knitted fabric 118, which may be fabricated of elasticized threads and thus be elasticized thereby. Following on from the annulus, there is knitted a garment body section 120 optionally and preferably having cut markings 122 integrally knitted therein to provide the edges that eventually form the leg apertures 126, 128 of the garment. Also shown, are waste material 130, 132 that is discardable, the front 134 and back 136 sections of the garment may again be constructed as a single seamless piece that, when joined together at their bottom parts 138 to form the crotch, provide a garment body section 124 that has only one seam (in the crotch). The preformer 110 as thus far described, is essentially similar to that disclosed in U.S. Pat. No. 6,164,094 to Francesco Lonati et al., referred to hereinabove. However, after the knitted garment body section 120, there is added at least one, and preferably two bands 112, 114 of edging material circumferentially and continuously knitted therewith. Where two bands 112, 114 are provided, these are preferably divided from each other by a simple strip of knitted fabric 116. The bands 112, 114 are designed to be separated from the preformer 120, and attached around the leg apertures that are formed when the garment is sewn up. Here again, there may be provided cutting guides integrally knitted into the preformer to indicate where the preformer should be cut to separate the edging bands from the remainder of the preformer.

The edging bands 112, 114 may be of identical construction to the waist band 118. However, unlike the waist band 118 which is knitted integrally to the garment's front section 134 and back section 136, the edging bands 112, 114 are designed to be cut away and repositioned around apertures. This allows all edges around all apertures of a garment to be knitted, regardless of the profile of the garment. In this manner, underpants having triangular profiles, and other non-rectangular garments, can be fabricated with all knitted seams, not just garments having rectangular profiles, such as boxer shorts and the like.

In some embodiments, by careful computerized design of the preformer, the bands 12, 14 (112, 114) may be correctly sized for attachment to the apertures 26, 28 (126, 128) of the garment as continuous loops of edging. In other embodiments, each band is slit open to form a ribbon-like strip of edging that may be cut to size and then sewn around an aperture, to provide an edging. This alternative manufacturing technique provides an alternative, perhaps less aesthetic, but much simpler construction method for garments.

As illustrated in FIGS. 1 and 2, the garment body section is formed with an integral waist annulus 18 (118) in accordance with the teaching of U.S. Pat. No. 6,164,094 to Francesco Lonati et al. This is, however, an optional feature. The waist bands themselves may also be knitted, cut and sewn to the garment body section as described hereinabove with regard to leg apertures. If the waist band is first knitted, then cut and then dyed, it may be dyed in a different colour from that chosen for dying the garment body section, perhaps a contrasting colour. Indeed, all the edging may be dyed in a contrasting colour to that used for the garment body section, however, a particular feature of the present invention is the possibility it offers to ensure that all edging and the garment body section are dyed to exactly the same shade. This is provided by all edging and the garment body section being fabricated from the same fibers on a similar if not the same machine, and dyed in the same batch.

The foregoing description refers to the fabrication of high-leg panties. It will be appreciated however, that other designs of panties may be fabricated in the manner described herein. Similarly, other items of clothing may be manufactured by sewing knitted edging to the body of the garment, including both underwear and overwear, daywear and nightwear, men's wear, ladies' wear and children's wear, particularly but not only, underpants, vests, leotards and the like.

Figure 3:
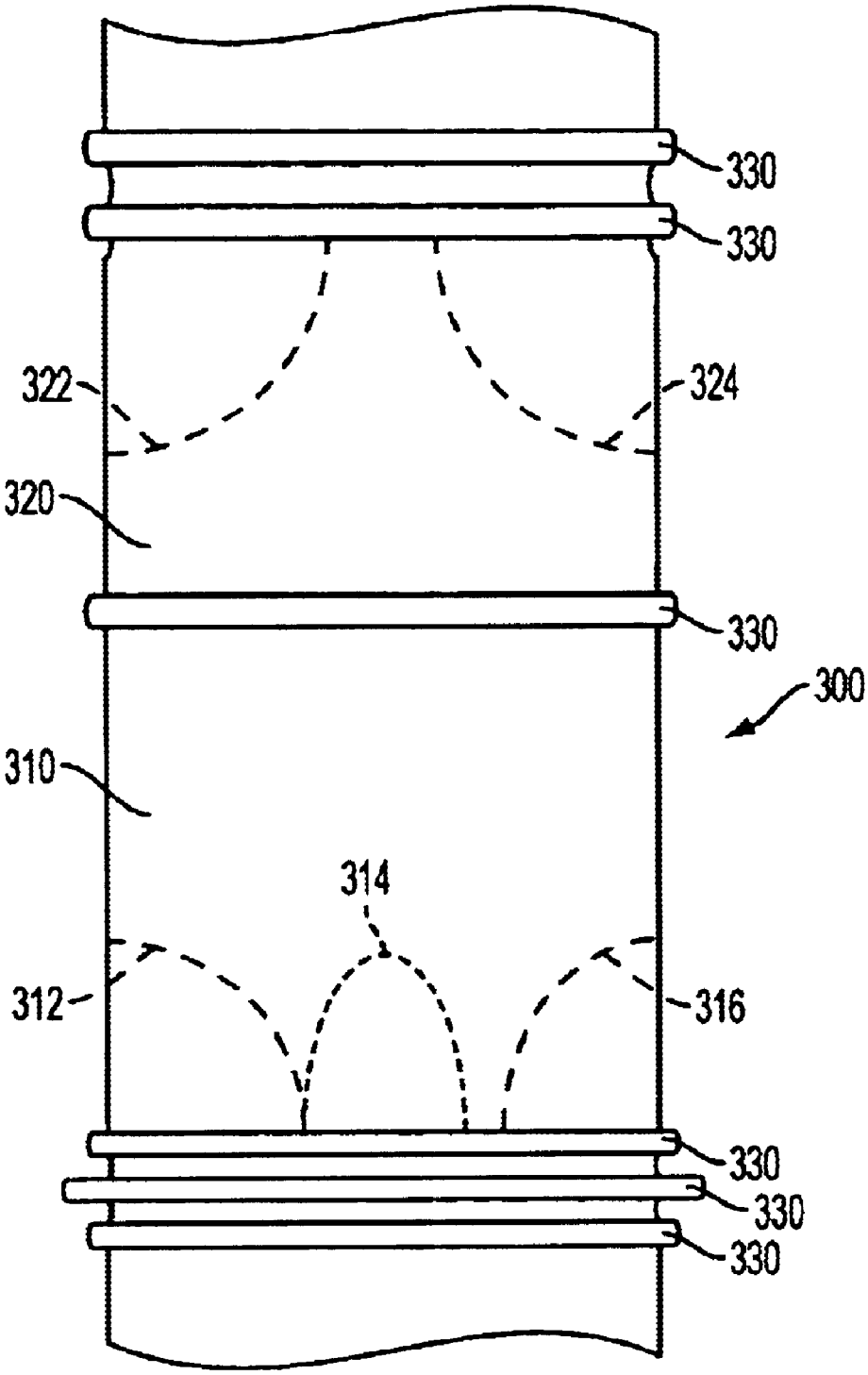
FIG. 3 shows a preformer for fabricating therefrom a two piece set of garments of knitted fabric having detachable knitted edges knitted therewith for attachment to the garment by sewing.

Referring now to FIG. 3, there is shown a preformer 300 from which may be cut a two piece set, consisting of a vest 310 and a pair of panties 320 for example. Cut marks 312, 314, 316, 322, 324 may be integrally knitted into the preformer 300 to guide the seamstress in cutting out the body parts of the garments. Also integrally knitted with the fabric for the body parts, are circumferentially knitted edging bands 330 which may be incorporated in the preformer before the vest and/or between the vest and panties, and/or after the panties. All three positions are shown in FIG. 3 for the purpose of illustration. It will be appreciated however, that a preformer for a vest and panties need not include edging bands in all three positions. Rather, all the bands may be together in any one position, or they may be positioned in any two of the three positions. Indeed the position of the vest and the panties may be reversed. Likewise, the vest and panties may be knitted upside-down, or in opposite orientations.

The advantages of including all parts of a two part set, including all edging, in a single preformer, is that in this manner it is easy to ensure a high degree of colour matching between the different parts of each garment and between both garments of a two part set. Furthermore, in this manner it is easy to ensure that both parts of the two part set are sent together to the seamstress for sewing. Although the two part set illustrated in FIG. 3 is a set consisting of vest 310 and panties 320, it will be appreciated that these dying and sewing advantages are also valid for other embodiments consisting of two piece sets, such as a swim suit consisting of a matching bikini top and bottom, a tunic and matching leggings, a bra and panties set, a matching bodysuit and skirt for a tennis player and the like.

The Santoni type tubular knitting machine used for knitting preformers which include garment body parts and edging parts to be subsequently cut out and then sewn together in accordance with the present invention may be a discontinuous tubular knitting machine that produces individual preformers for individual garments or for two piece sets. Alternatively, the Santoni type tubular knitting machine may be a continuous knitting machine that produces a continuous preformer from which may be cut body parts and edgings for a number of garments. It will be appreciated that where a continuous preformer is manufactured, it may be arranged to have the circumferential bands of edging material interspaced with the body parts, or alternatively, a batch of body parts for several garments may be knitted one after another, followed or preceded by a batch of edging bands for edging several garments, knitted one after another.

Figure 4:
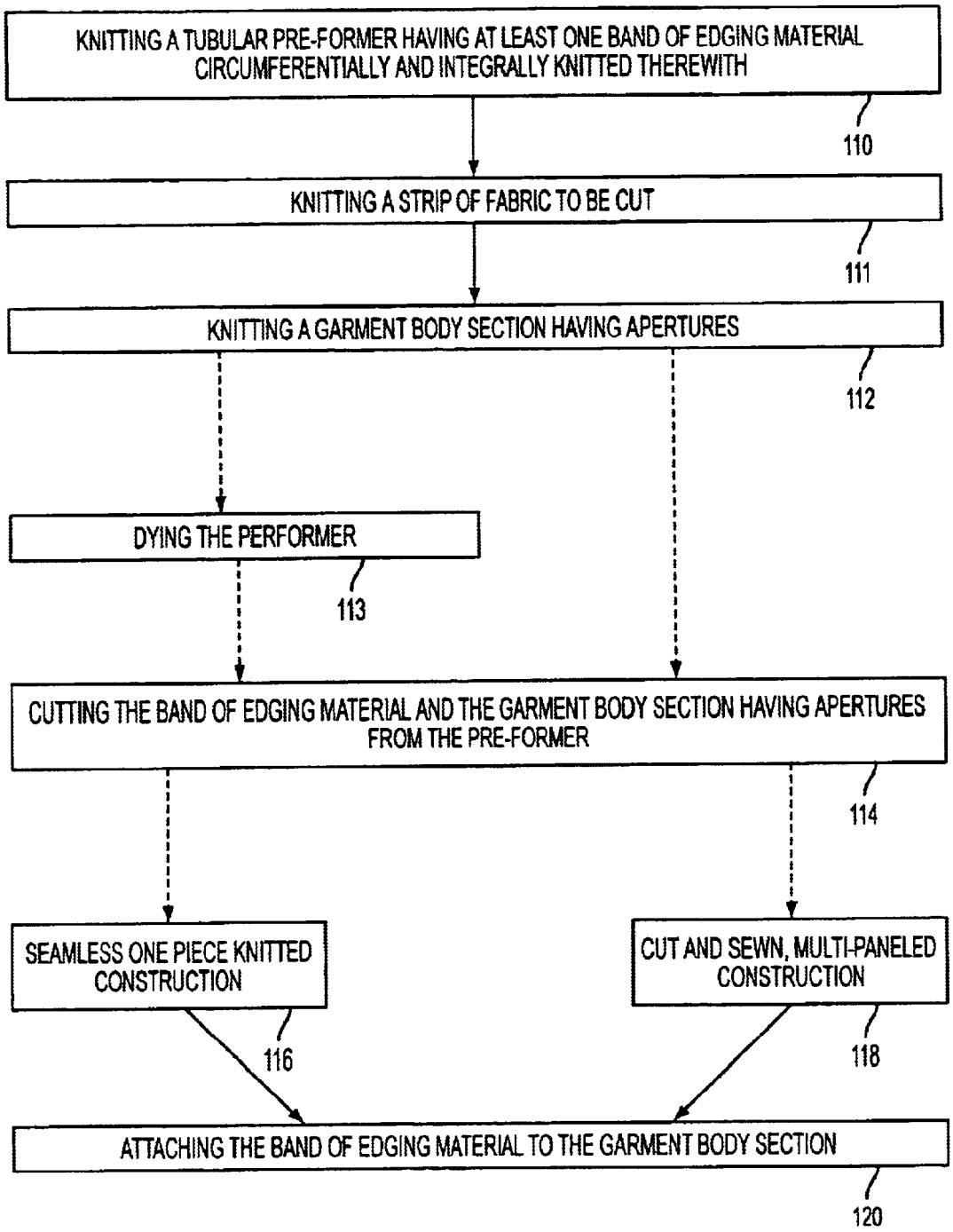
FIG. 4 is a flowchart illustrating one process for fabricating knitted garments having knitted edges attached thereto, in accordance with the present invention.

Referring now to FIG. 4, there is shown a flowchart illustrating one process for fabricating garments having knitted edges attached thereto, in accordance with the present invention.

The process consists of the step of knitting a tubular preformer having at least one band of edging material circumferentially and integrally knitted therewith (Step 110). The band of edging material is formed by knitting an annulus that may include elastic threads as known in the prior art, and widely used for fabricating integral waist bands of one piece underpants and the like. However, in contradistinction to continuing to knit the body of the garment straight after the annulus, permanently knitted thereto in the manner described in U.S. Pat. No. 6,164,094/EP 0926285 for example, in this novel process, after the band of edging material, there is knitted a strip of knitted fabric (111), which is designed to be cut away. Optionally this strip will have cutting guide marks knitted therein. Cutting through this strip of knitted fabric separates the band from the rest of the preformer.

Following this band of detachable edging material, a garment body section having apertures is now knitted (Step 112). This step may be performed on a continuous knitting machine such as the Santoni® knitting machine widely used in the clothing industry. Optionally, the garment body section may have an integral permanently fixed elastic waist band knitted thereto, in the manner described in U.S. Pat. No. 6,164,094/EP 0926285 for example.

It will be appreciated that the preformer may be formed in the opposite order, such that firstly the garment body parts are knitted, (with or without integral waist bands), and only then, the detachable bands are knitted below the garment part. Either way, the detachable bands and the body parts are provided together as a kit.

The preformer is now optionally dyed (Step 113). Since the edging bands and the fabric used for the body of the garment are manufactured together using similar fibers and knitting techniques, and are dyed together, a high colour matching between the body of the garment and the edging is achieved.

Then the band of edging material and the garment body sections are cut from the preformer (Step 114). If the garment body section has a seamless one piece construction, it will be cut out in one piece (Step 116). Alternatively, if fabricated from a plurality of pieces by cut and sew techniques, each piece will be cut out and then sewn together (Step 118). Finally, the bands of edging material are sewn to the garment body section to finish the garment (Step 120).

Figure 5:
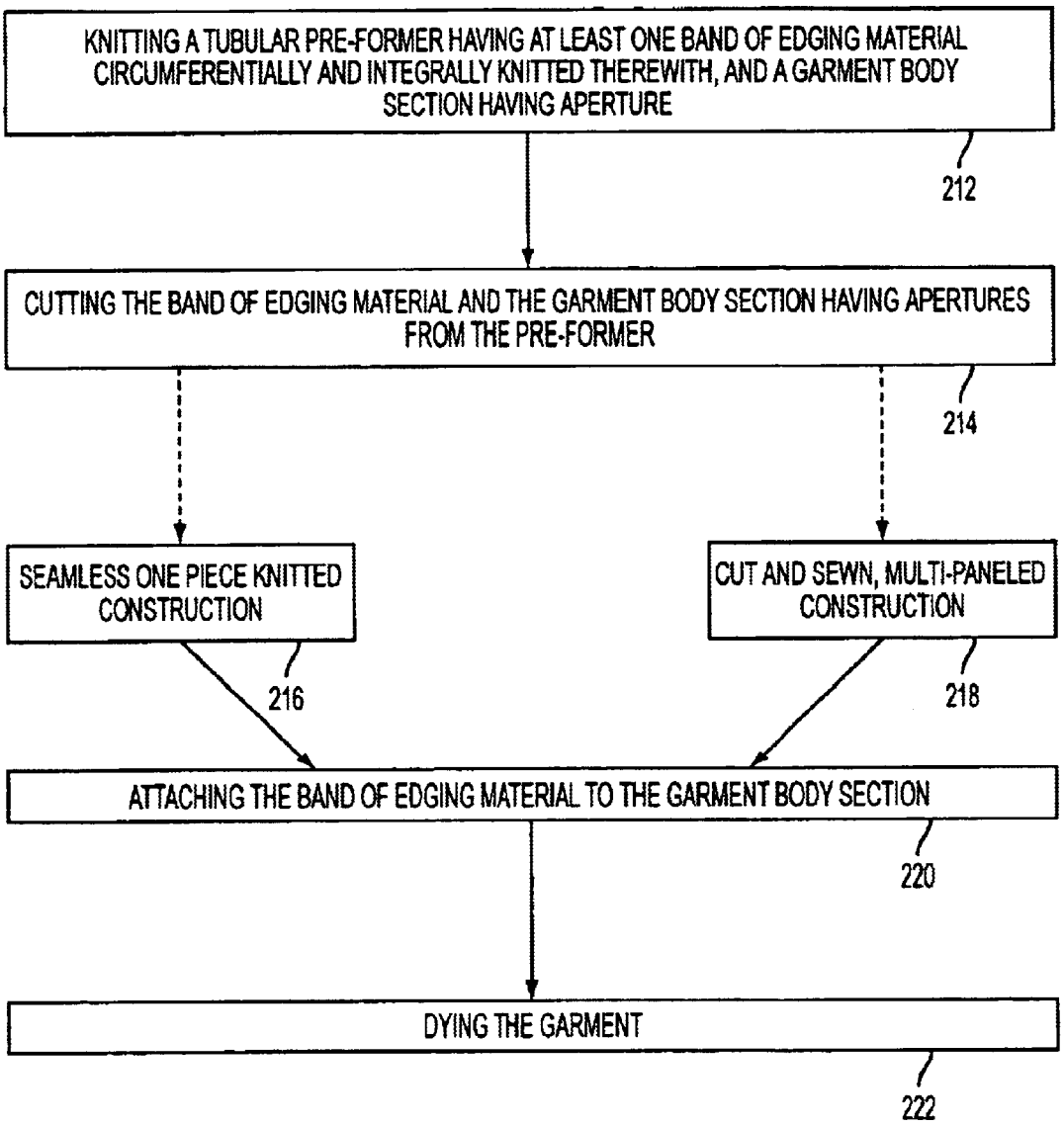
FIG. 5 is a flowchart illustrating a second process for fabricating knitted garments having knitted edges attached thereto, in accordance with the present invention.

Referring now to FIG. 5, there is shown a second flowchart illustrating a second process for fabricating garments having knitted edges attached thereto, in accordance with the present invention.

The process consists of the step of knitting a tubular preformer having at least one band of detachable edging material, and a garment body section having apertures (Step 212) integrally knitted therein. This step may be performed on a continuous knitting machine such as the Santoni® knitting machine.

Then the band of non-dyed edging material and the garment body sections are cut from the preformer (Step 214). If the garment body section has a seamless one piece construction, it will be cut out in one piece (Step 216). Alternatively, if fabricated from a plurality of pieces by cut and sew techniques, each piece will be cut out and then sewn together (Step 218). The bands of edging material are now attached to the garment body section, usually by way of sewing, to "finish" the non-dyed garment (Step 220). The finished garment may now be dyed (Step 222). Since the edging bands and the fabric used for the body of the garment are manufactured together using similar fibers and knitting techniques, and are dyed together, a high colour matching between the body of the garment and the edging is achieved.

Thus the present invention provides novel preformers for fabrication of garments, novel garments having elasticized knitted seams sewn around apertures thereof, and novel methods for fabrication of garments. It is particularly useful, but not restricted to the manufacture of undergarments such as underpants and vests.

It will be appreciated that both the edging bands and the body parts of the preformer may additionally include knitted in patterns, stripes, textures and other features as known to the man of the art as being fabricable using continuous or discontinuous circular knitting machines, such as those made by Santoni, Orizio, Sangiacomo and their competitors.

The foregoing description of some embodiments and manufacturing techniques are provided for illustrative purposes only, the present invention being defined by the claims appended hereinafter, wherein the word "comprise", and variations thereof, such as "comprises", "comprising", "comprised" and the like, imply the inclusion of the specifically mentioned steps or components, but not to the exclusion of other steps or components.

What is claimed is:

1. A method for fabricating a garment comprising the steps of;

(a) knitting a tubular preformer comprising at least one band of edging material circumferentially and integrally knitted therein;

(b) continuing knitting the knitted tubular preformer to include a knitted fabric section from which a garment body section for a garment having an aperture may be cut;

(c) cutting the band of edging material and the garment body section from the preformer, and (d) attaching the band of edging material to the garment body section along edge of said aperture.

2. The method for fabricating a garment of claim 1, wherein the knitting of the tubular preformer is performed on a circular knitting machine such as those manufactured by Santoni, Orizio and Sangiacomo.

3. The method for fabricating a garment as claimed in claim 1, wherein the garment has a construction selected from the list of seamless one piece knitted constructions and cut and sewn, multi-paneled constructions.

4. The method for fabricating a garment as claimed in claims 1, wherein the band of edging fabric is fabricated from fibers that include elastic fibers, and the band of edging material is elasticized.

5. The method for fabricating a garment as claimed in claim 1, wherein the band of edging material is attached around an aperture of the garment as a continuous loop.

6. The method for fabricating a garment, as claimed in claim 1, wherein the band of edging material is opened out into a length of edging fabric, and is attached around the aperture of the garment as a loop having a seam.

7. The method for fabricating a garment as claimed in claim 1, wherein the step of attaching the band to the garment is by sewing.

8. The method for fabricating a garment as claimed in claim 1, further comprising the step of dying said at least one band of edging material and said garment body section, wherein said step of dying is performed either before or after said sewing step.

9. The method for fabricating a garment as claimed in claim 1, further comprising at least one further knitted edge formed integrally with the body of the garment, and knitted thereto.

10. The method for fabricating a garment as claimed in claim 1, wherein said garment is an item of underwear.

11. A garment manufactured by the method of claim 1, the garment having a body section of knitted fabric and having at least one aperture having a knitted edge attached therearound.

12. The garment of claim 11, wherein said body section and said edge are co-dyed to a uniform colour.

13. A garment manufactured by the method of claim 2, the garment having a body section of knitted fabric and having at least one aperture having a knitted edge attached therearound.

14. The garment of claim 13, wherein said body section and said edge are co-dyed to a uniform colour.

15. A garment manufactured by the method of claim 3, the garment having a body section of knitted fabric and having at least one aperture having a knitted edge attached therearound.

16. The garment of claim 15, wherein said body section and said edge are co-dyed to a uniform colour.

17. A garment manufactured by the method of claim 4, the garment having a body section of knitted fabric and having at least one aperture having a knitted edge attached therearound.

18. The garment of claim 17, wherein said body section and said edge are co-dyed to a uniform colour.

19. A garment manufactured by the method of claim 5, the garment having a body section of knitted fabric and having at least one aperture having a knitted edge attached therearound.

20. The garment of claim 19, wherein said body section and said edge are co-dyed to a uniform colour.

21. A garment manufactured by the method of claim 6, the garment having a body section of knitted fabric and having at least one aperture having a knitted edge attached therearound.

22. The garment of claim 21, wherein said body section and said edge are co-dyed to a uniform colour.

23. A garment manufactured by the method of claim 7, the garment having a body section of knitted fabric and having at least one aperture having a knitted edge attached therearound.

24. The garment of claim 23, wherein said body section and said edge are co-dyed to a uniform colour.

25. A garment manufactured by the method of claim 8, the garment having a body section of knitted fabric and having at least one aperture having a knitted edge attached therearound.

26. The garment of claim 25, wherein said body section and said edge are co-dyed to a uniform colour.

27. A garment manufactured by the method of claim 9, the garment having a body section of knitted fabric and having at least one aperture having a knitted edge attached therearound.

28. The garment of claim 27, wherein said body section and said edge are co-dyed to a uniform colour.

29. A garment manufactured by the method of claim 10, the garment having a body section of knitted fabric and having at least one aperture having a knitted edge attached therearound.

30. The garment of claim 29, wherein said body section and said edge are co-dyed to a uniform colour.

31. A circularly knitted preformer for a garment comprising a plurality of bands of edging material circumferentially and integrally knitted therewith and separated by layers of a cuttable waste material, and further comprising a knitted fabric section of suitable knit and size for the fabrication thereof of at least one garment body section, wherein said bands of edging material are detachable from said preformer by cutting through said cuttable waste material, and are attachable around a perimeter of an aperture of a garment formed from said knitted fabric section, by sewing.

32. The circularly knitted preformer for a garment as claimed in claim 31, wherein at least one garment body section comprising a front panel circularly knitted to a back panel is cuttable from said knitted fabric section for provision of a garment without side seams.

33. The circularly knitted preformer for a garment as claimed in claim 31, wherein a plurality of garment body sections are cuttable from said knitted fabric section to be subsequently sewn together for the provision of a multi-paneled garment.

34. The circularly knitted preformer for a garment as claimed in claim 31, wherein said knitted fabric section for the fabrication thereof of at least one garment body section has cut guide markings integrally knitted therein.

35. The circularly knitted preformer for a garment as claimed in claim 32, wherein said knitted fabric section for the fabrication thereof of at least one garment body section has cut guide markings integrally knitted therein.

36. The circularly knitted preformer for a garment as claimed in claim 33, wherein said knitted fabric section for the fabrication thereof of at least one garment body'section has cut guide markings integrally knitted therein.

37. A circularly knitted preformer for a plurality of garments comprising a plurality of bands of edging material circumferentially and integrally knitted therewith and separated by layers of a cuttable waste material, and further comprising a knitted fabric section of suitable knit and size for the fabrication thereof of body sections for at least two garments, wherein said bands of edging material are detachable from said preformer by cutting through said cuttable waste material, and are attachable around a perimeter of an aperture of a garment formed from said knitted fabric section, by sewing.

38. A circularly knitted preformer for a plurality of garments as claimed in claim 37 wherein said at least two garments includes at least two substantially identical garments.

39. A circularly knitted preformer for a plurality of garments as claimed in claim 37 wherein said at least two garments includes a bottom garment and a top garment, wherein said bottom garment and said top garment comprise a two part matching set.

* * * * *